United States Patent [19]

Joelson

[11] Patent Number: 4,798,698

[45] Date of Patent: Jan. 17, 1989

[54] CLOSED LOOP SYSTEM FOR THE MANUFACTURE AND HANDLING OF CONCRETE PIPE

[76] Inventor: Carl R. Joelson, 2501 Bayshore Rd., Nokomis, Fla. 33555

[21] Appl. No.: 135,542

[22] Filed: Dec. 18, 1987

Related U.S. Application Data

[63] Continuation of Ser. No. 853,205, Apr. 17, 1986, abandoned.

[51] Int. Cl.[4] ..... B28B 21/14; B28B 21/56

[52] U.S. Cl. ..... 264/271.1; 264/71; 264/333; 264/336; 264/DIG. 43

[58] Field of Search ..... 264/71, 256, 271.1, 264/333, 336, DIG. 43, 265

[56] References Cited

U.S. PATENT DOCUMENTS

| | | | |
|---|---|---|---|
| 3,234,617 | 2/1966 | McGrew et al. | 425/253 |
| 3,344,492 | 10/1967 | Eggling et al. | 425/88 |
| 3,550,225 | 12/1970 | Smith | 425/432 |
| 3,551,907 | 1/1971 | Williams | 425/117 |
| 3,577,610 | 5/1971 | Margolin | 425/432 |
| 3,584,356 | 6/1971 | Joelson | 425/117 |
| 3,659,979 | 5/1972 | Schneider et al. | 425/88 |
| 3,677,686 | 7/1972 | Powell | 425/253 |
| 3,696,182 | 10/1972 | Joelson | 264/72 |
| 3,751,205 | 8/1973 | Patten | 425/253 |
| 3,957,937 | 5/1976 | Lovell | 264/DIG. 43 |
| 4,553,893 | 11/1985 | Kaschner et al. | 198/345 |

FOREIGN PATENT DOCUMENTS

| | | | |
|---|---|---|---|
| 241145 | 3/1960 | Australia | 425/62 |
| 897519 | 1/1982 | U.S.S.R. | 425/225 |

*Primary Examiner*—Willard Hoag

*Attorney, Agent, or Firm*—Stevens, Davis, Miller & Mosher

[57] ABSTRACT

An improved method for moving a large, heavy, fragile, freshly-made concrete pipe section, with top and bottom pallets but without jacket protection, out of a casting machine, and directly into a kiln, for curing; moving the cured pipe section from the kiln to an unloading station, automatically removing the top pallet, removing the pipe section from the bottom pallet, cleaning the top pallet and then placing the top pallet on a reinforcing cage that has been set on the bottom pallet, ready for the next cycle. The cycle is continuously intermittant.

1 Claim, 12 Drawing Sheets

CLOSED LOOP SYSTEM FOR THE MANUFACTURE AND HANDLING OF CONCRETE PIPE

This application is a continuation of application Ser. No. 853,205 filed Apr. 17, 1986, now abandoned.

The present invention relates to a closed loop system for the manufacture and handling of reinforced concrete pipe. More particularly, the present invention relates to an improved method and apparatus for moving a large, heavy, fragile, freshly-made concrete pipe section, with top and bottom pallets but without jacket protection, out of a casting machine and directly into a kiln for curing; moving the cured pipe section from the kiln to an unloading station; automatically removing the top pallet from the pipe section; removing the pipe section from the bottom pallet; cleaning the top pallet and then placing the top pallet on a reinforcing cage that has been set on the bottom pallet, ready for the next cycle.

BACKGROUND OF THE INVENTION

In the manufacture of reinforced concrete pipes in a vertical position, two different concepts are used that are generally referred to as (1), wet cast, and (2), dry cast.

In the wet cast operation, high slump concrete is used and is poured into a liquid tight form. The concrete mix generally stays in the form for 24 hours, so the concrete can harden. Then the forms and pallets are removed. Production is limited to the number of (expensive) forms and pallets that are available. This concept is well suited to producing very large pipe.

In the dry cast operation, no slump concrete is used in the formation of the concrete pipe. The jacket and core and sometimes the top pallet are removed immediately after the pipe has been formed.

In placing no slump concrete into vertical forms, generally, three different methods are used to densify the mix sufficiently, so that the pipe will not collapse when the forms are removed.

In the first dry cast method, the mix is placed into the forms and packed or densified by tamping in a tamping machine.

In the second dry cast method, the mix is placed in the form and is packed by rollers in a packerhead machine.

In the third dry cast method, the mix is placed in the forms and vibrated, causing the mix to turn into a semi-fluid mix and to settle and densify. Reference is made to U.S. Pat. Nos. 3,584,356 and 3,696,182.

When the vibration ceases, the fluid mix reverts back to a firm, dense, and relatively stable mix, so that forms can be removed immediately, without causing the newly made pipe to collapse.

The present invention relates in part, to the third method. In using the third method, the pipe is formed in the machine, and then the jacket and core, that are a part of the machine, are stripped from the pipe, leaving the pipe in the machine supported only by its bottom pallet.

Customarily, two procedures of moving the pipe from the machine to the curing area are utilized.

In the first procedure, the newly made pipe on its bottom pallet (with or without a top pallet) is slowly and carefully raised off of the machine's saddle by a fork truck, which then has to reverse to back out of the machine, then stop to shift gears, then turn to proceed to the curing area, then lower the pipe with its pallet to the floor, then reverse to clear the pipe and pallet, then stop and turn and proceed to the casting machine for another pipe.

In the second procedure the newly made pipe is moved out of the machine by an off-bearing apparatus, which inserts its forks under the outside edges of the bottom pallet, then raises the pipe with its bottom pallet, off of the saddle. Then the forks, which are attached to an overhead carriage which rides on an overhead track (rails), move the pipe and bottom pallet out from under the machine and lowers and deposits the pipe and lower pallet onto a moving floor that generally runs at right angle to the machine.

This apparatus, when automated, eliminates the need of a fork truck and operator.

In either procedure, the forks raise the pallet, with the forks being positioned on the outer circumference of the pallet. The weight of larger pipe will cause the section in the middle of the pallet to sag, progressively more, as pallet size increases. This sagging causes cracks and the pulling of the concrete away from the reinforcing wires, sometimes causing pieces of the green pipe to fall off, or the pipe to collapse.

These two systems of removing the forms from the pipe in the machine and then removing the pipe from the machine on only its bottom pallet, are well suited to pipes from 12" to 36" in dia., due to the fact that in these smaller sizes, the bottom pallets are relatively rigid.

In pipe of larger sizes, i.e. 48" to 96" plus, the difficulty of safely removing these sizes of pipe from the machine, becomes progressively greater as sizes increase.

Because of this sagging problem with larger pipe, another procedure is widely used, in which the forms are filled with no slump concrete at a central filling station, and vibrated. Then a top pallet is manually placed on top of the mix to form a tongue (or groove).

The pipe in this form is then transported by overhead crane or fork-truck to the curing area. The forms are manually removed and the pipe left standing on its bottom pallet.

The top pallets weighing as much as 400 lbs. are removed from cured pipe in the curing area by hooks attached to an overhead crane or fork-truck, then moved to an area adjacent to the filling station, then lowered and cleaned, then after the form is filled, the top pallet is raised and placed on top of the mix to form the tongue, then tranported again to the curing area. All of this is accomplished in close proximity to 3 or 4 men, which creates a hazardous situation.

The forms which have been removed from the pipe are manually reassembled around another bottom pallet with its reinforcing cage and the empty form and top pallet transported back to the filling station, and the cycle repeated.

In this procedure, the green pipe has the protection of the outer jacket, which also grips the outer circumference of the bottom pallet, preventing any flexing, while being moved to the curing stage. The loss of pipe due to breaking apart is minimal.

On the other hand, these current procedures are complex, slow, costly, and hazardous in producing and handling pipe of a larger size.

It is, therefore, an object of the present invention to provide an improved means of handling large, newly-made pipe from the forming machine through curing without harm to the pipe.

A further object of this invention is to provide a method and apparatus which simplifies the handling and moving of concrete pipe, both green and cured, with top and bottom pallets.

Another object of the present invention is to provide a method and apparatus which will reduce the number of personnel required to handle the newly-made pipe from forming machine through curing to storage.

A still further object of the present invention is to provide a method and apparatus which will render less hazardous the handling of pipe, both green and cured on pallets.

Another object of the present invention is to provide a less costly method and apparatus for handling both green and cured pipe.

A still further object of the present invention is to provide an apparatus for safely handling the precision top pallets that are compatable with the bottom pallets in making precision gasket joints.

A further object of the present invention is to provide an apparatus which will safely remove the top pallet from a cured pipe, clean, oil and then place it on a cage that is sitting on a pallet car, ready to be moved to a pipe machine.

A still further object of the present invention is to provide an apparatus for clamping, lifting, removing and rotating the cured pipe from the loop system.

A further object of this invention is to provide a system for the removal of pallets from cured pipe for substantially immediate re-use, and stockpiling pipe that were previously manufactured during current manufacturing.

A still further object of the present invention is to provide a system whereby the pallet cars are automatically positioned in designated respective positions, during the manufacturing and handling cycle.

SUMMARY OF THE INVENTION

The foregoing objects have been attained by a closed loop track system upon which cars having bottom pallets fixed thereto move. Along the loop are a pipe-section-forming unit, a kiln for curing green pipe-sections, a gantry crane for removing a top pallet from a cured pipe section, cleaning the top pallet and placing the top pallet on a reinforcing cage positioned on a car preceding the car from which the pallet was removed and a pipe clamping and repositioning unit which clamps the pipe, removes the pipe from car and loop system and repositions the pipe for easy removal to a storage area.

The removal, cleaning and replacement of the top pallet is accomplished by one man with the gantry crane. With the closed loop system the pallet cars are automatically positioned in their designated respective positions during the pipe manufacturing cycle.

The method constitutes moving a large, heavy, fragile, freshly-made concrete pipe section, with top and bottom pallets but without jacket protection, out of a casting machine and directly into a kiln for curing; moving the cured pipe section from the kiln to an unloading station; automatically removing the top pallet from the pipe section; removing the pipe section from the bottom pallet; cleaning the top pallet and then placing the top pallet on a reinforcing cage that has been set on a bottom pallet, ready for the next cycle.

BRIEF DESCRIPTION OF THE DRAWINGS

Other details and features of the invention will stand out from the description given below by way of nonlimitative example and with reference to the accompanying drawings, in which.

DETAILED DESCRIPTION OF THE DRAWINGS

Figure 1:
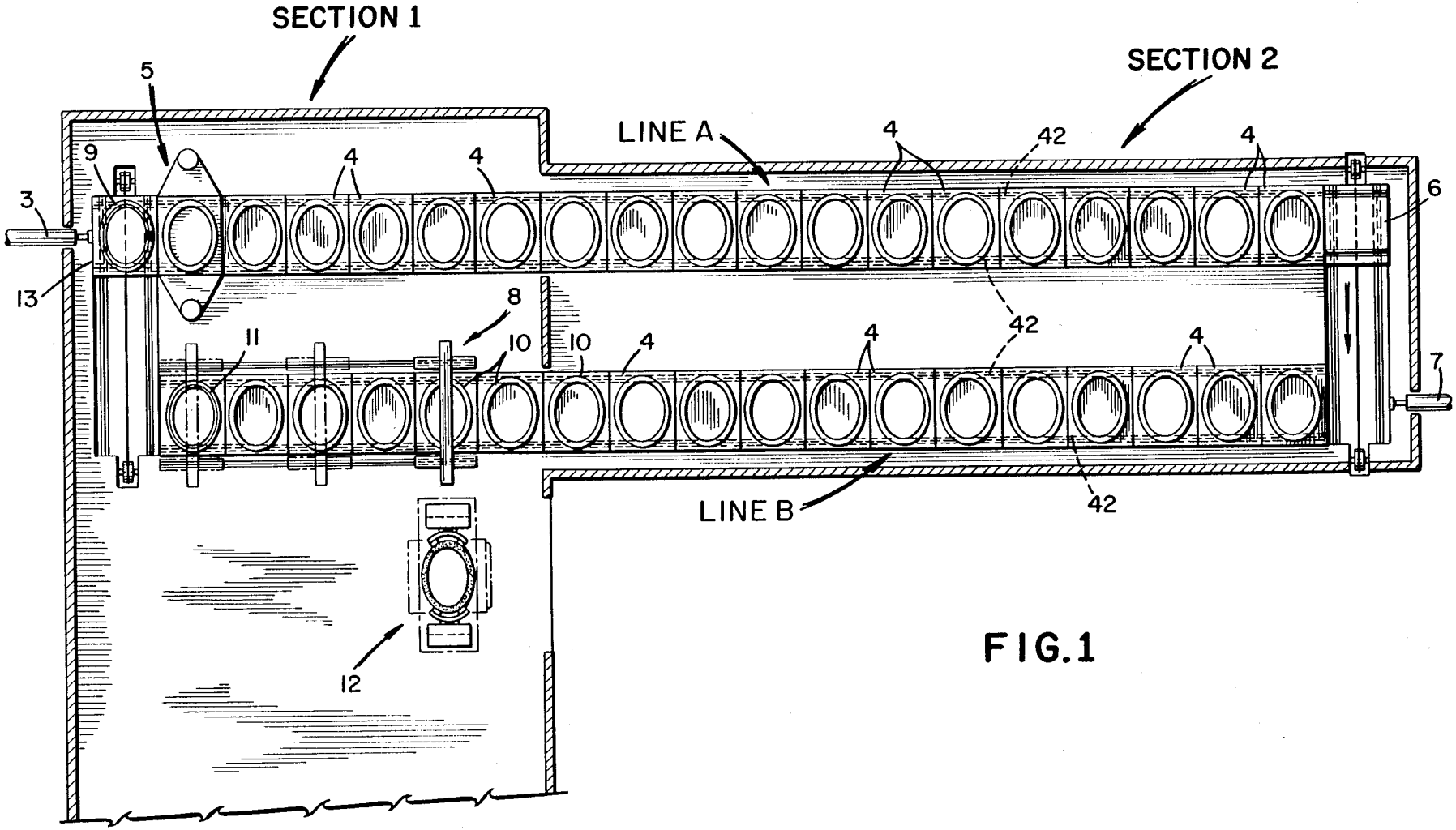
FIG. 1 is a plan view of the closed loop system of the present invention.

FIG. 1 shows a plan view of a closed loop reinforced concrete continuous pipe production system. The building in which the system is housed is divided essentially into a section 1 for making and removing the pipe and a section 2 which is a kiln for curing the freshly produced green pipe.

The loop system comprises a hydraulic ram 3 for intermittently moving the pallet cars 4 along line A, a pipe forming unit 5 straddling line A for forming pipe sections, a transfer car 6 moving between lines A and B for transferring a pallet car 4 from line A to line B, a hydraulic ram 7 for intermittently moving pallet cars 4 along line B, a gantry crane 8 for removing top pallets 9 from cured pipe 10 and placing the top pallet on a reinforcing cage 11, a pipe clamping and repositioning unit 12 for removing the cured pipe from the pallet car 4, withdrawing the pipe 10 from the loop and rotating the pipe 10 for receipt by a forklift and a transfer car 13 moving between lines B and A for transferring a pallet car 4 with cage and top pallet from line B to line A.

Figure 2:
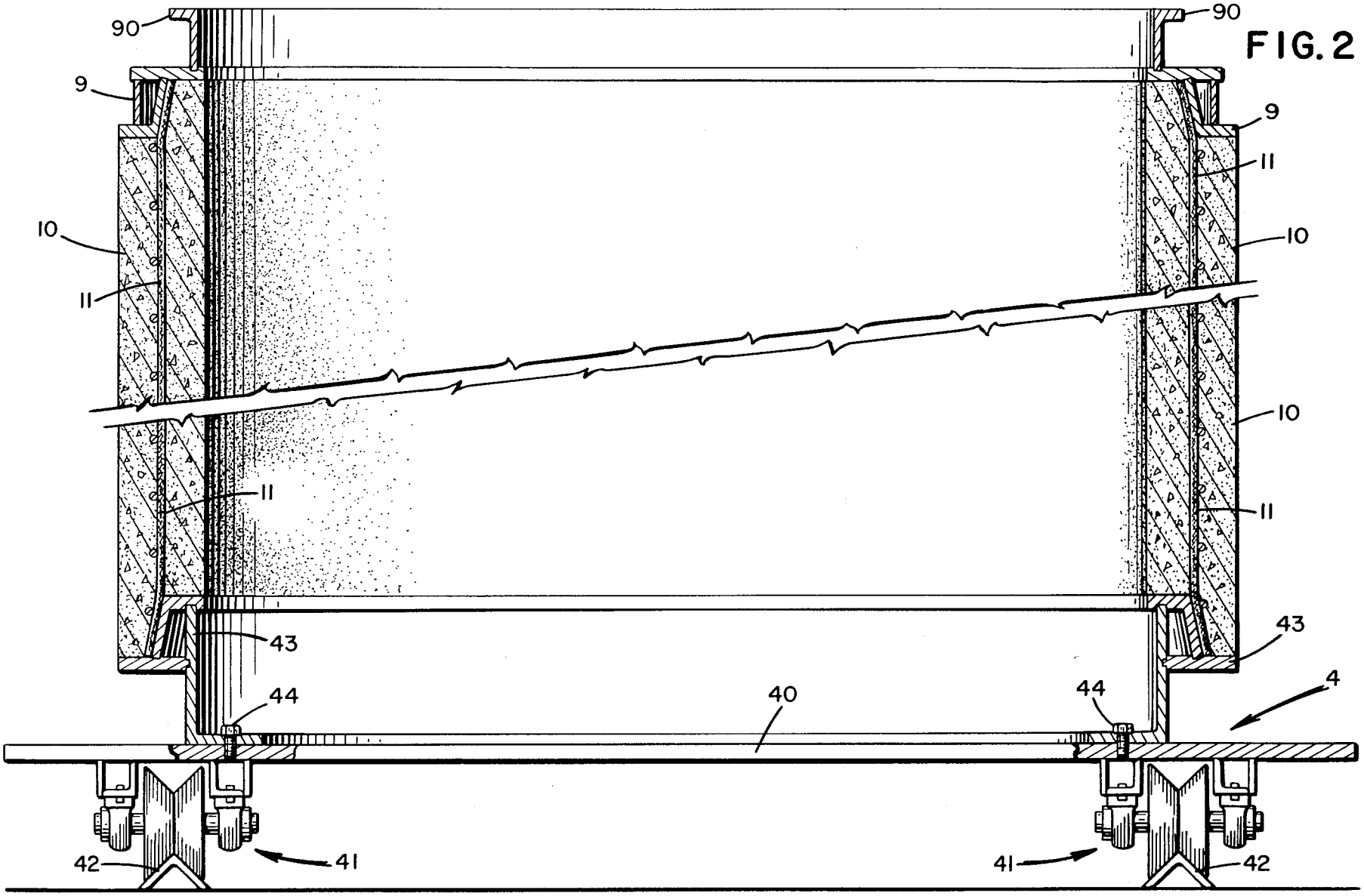
FIG. 2 is an elevated sectional view of a pallet car of the present invention.

FIG. 2 shows in detail a cross-section of a pallet car 4. Car 4 has a platform 40 made from steel plate which is sufficiently thick to support the weight of the concrete pipe 10 reinforced by the wire reinforcing cage 11. The platform 40 is mounted on wheels 41 for movement along the rails 42 (lines A and B). Supported on platform 40 is a bottom pallet 43 shaped to form a matrix for the lower end of the concrete pipe section 10. The lower pallet 43 is bolted at 44 to platform 40. On top of the concrete pipe 10 is a top pallet 9 forming a matrix for the top end of the concrete pipe section 10. A flange 90 is fixed to the top of pallet 9 to enable removing the top pallet 9 from the concrete pipe section 10 once it is cured.

Figure 3:
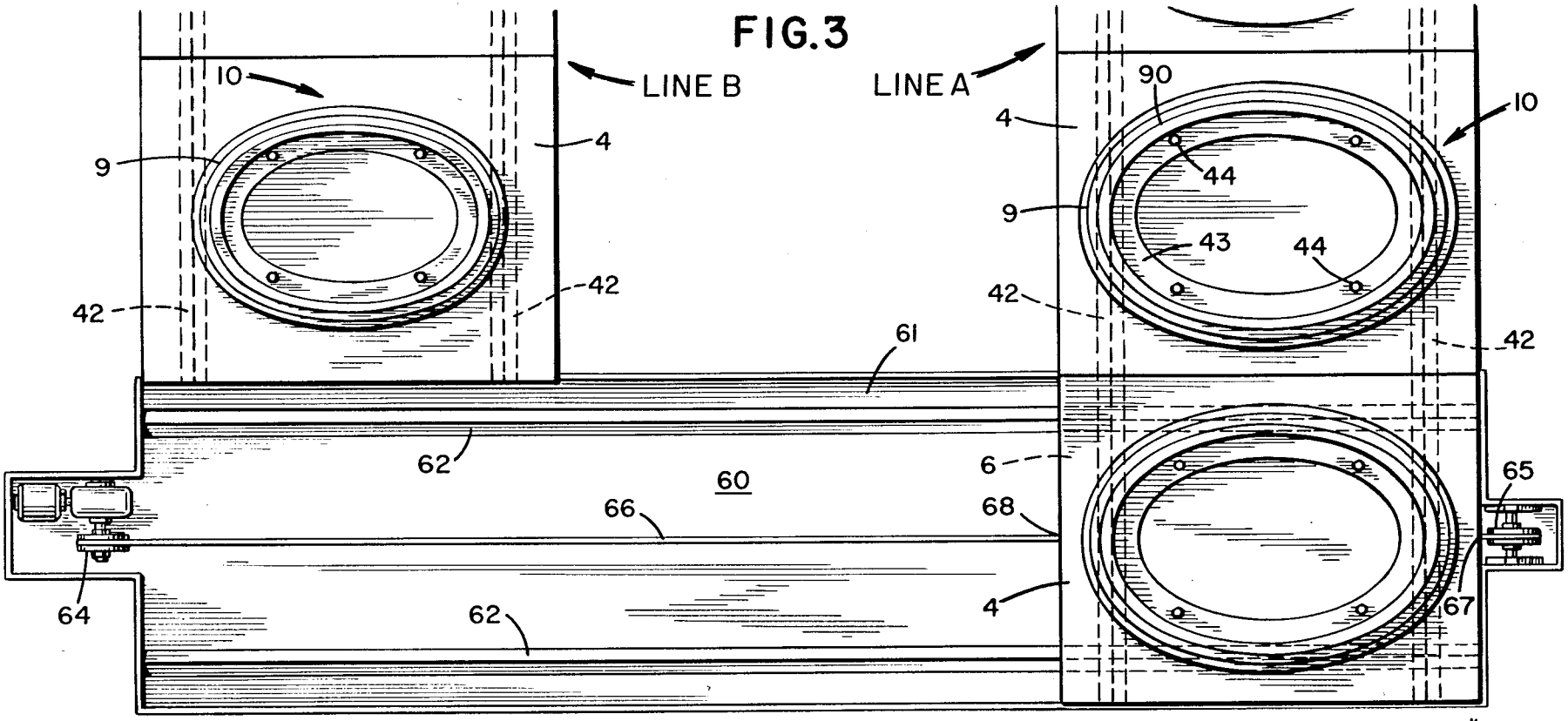
FIG. 3 is a plan view of a pallet car transfer section from line A to line B of FIG. 1.
Figure 4:
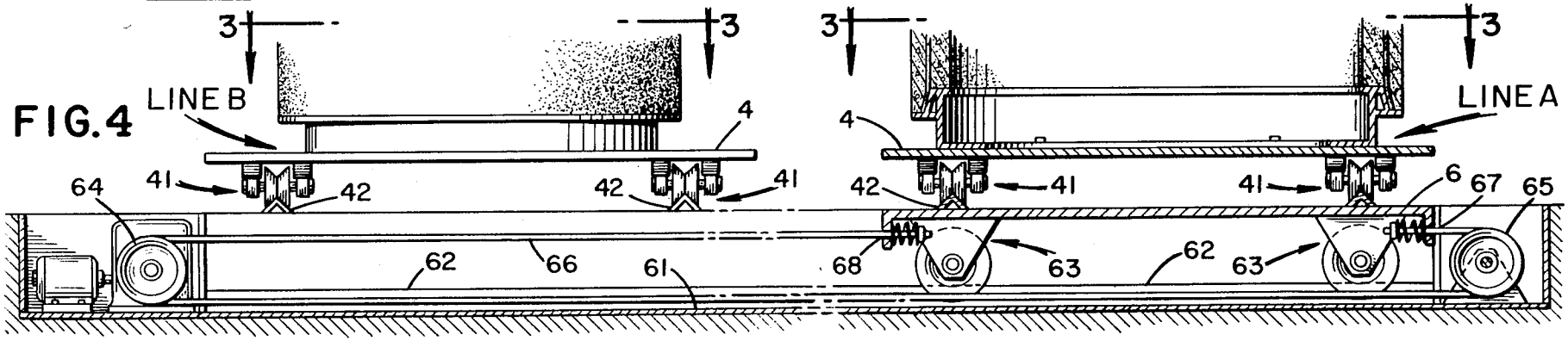
FIG. 4 is a side elevational view partially in section of the transfer section of FIG. 3.

FIGS. 3 and 4 show a pallet car 4 carrying partially cured pipe, a shallow pit 60, the floor 61 of which is positioned lower than the level of track for lines A and B, rails 62 mounted on the floor 61 of pit 60, a transfer car 6 with wheel assemblies 63 rolling on the rails 62, rails 42 mounted transversely on car 6 which are level with the tracks of lines A and B so that a pallet car 4 can be rolled onto car 6 from line A and off of car 6 onto line B.

On either end of the transfer section pit, are mounted, a reversible motorized, drive sprocket 64 and an idler sprocket 65 over which a roller chain 66 is passed for moving the transfer car 6 in either direction. One end of the roller chain 66 is springingly attached at one end 67 to transfer car 6. From end 67 the chain 66 passes around idler sprocket 65 under transfer car 6, around reversible motorized drive sprocket 64 and springingly attaches at 68 to the other end of transfer car 6. Since motorized drive sprocket 64 is reversible and sprocket 65 is an idler, transfer car 6 can be easily pulled in either direction.

Figure 5:
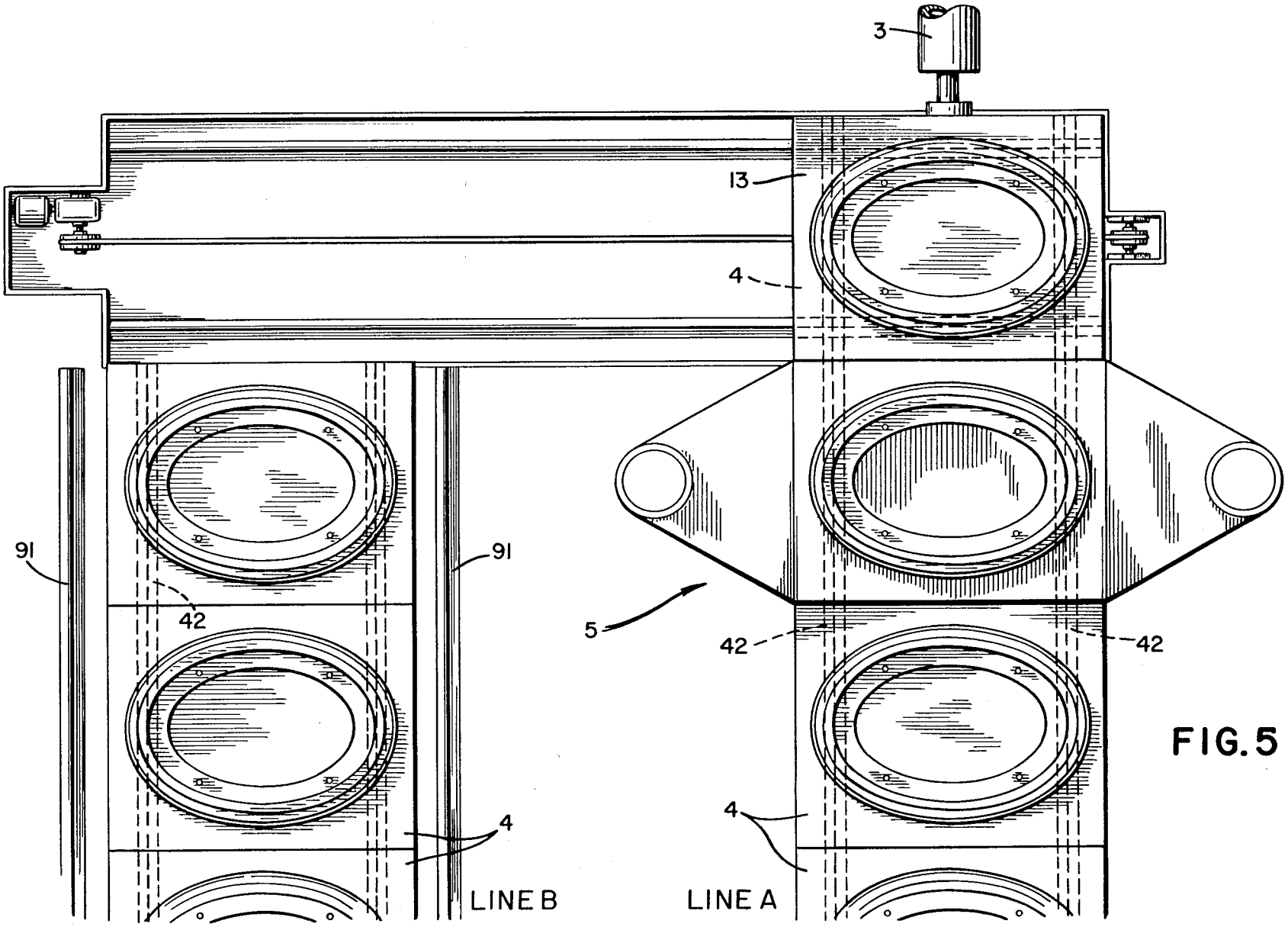
FIG. 5 is a plan view of a pallet car transfer section from line B to line A of FIG. 1.

FIG. 5 shows transfer car 13 which is identical to transfer car 6. For brevity a detailed description is omitted.

Figure 6:
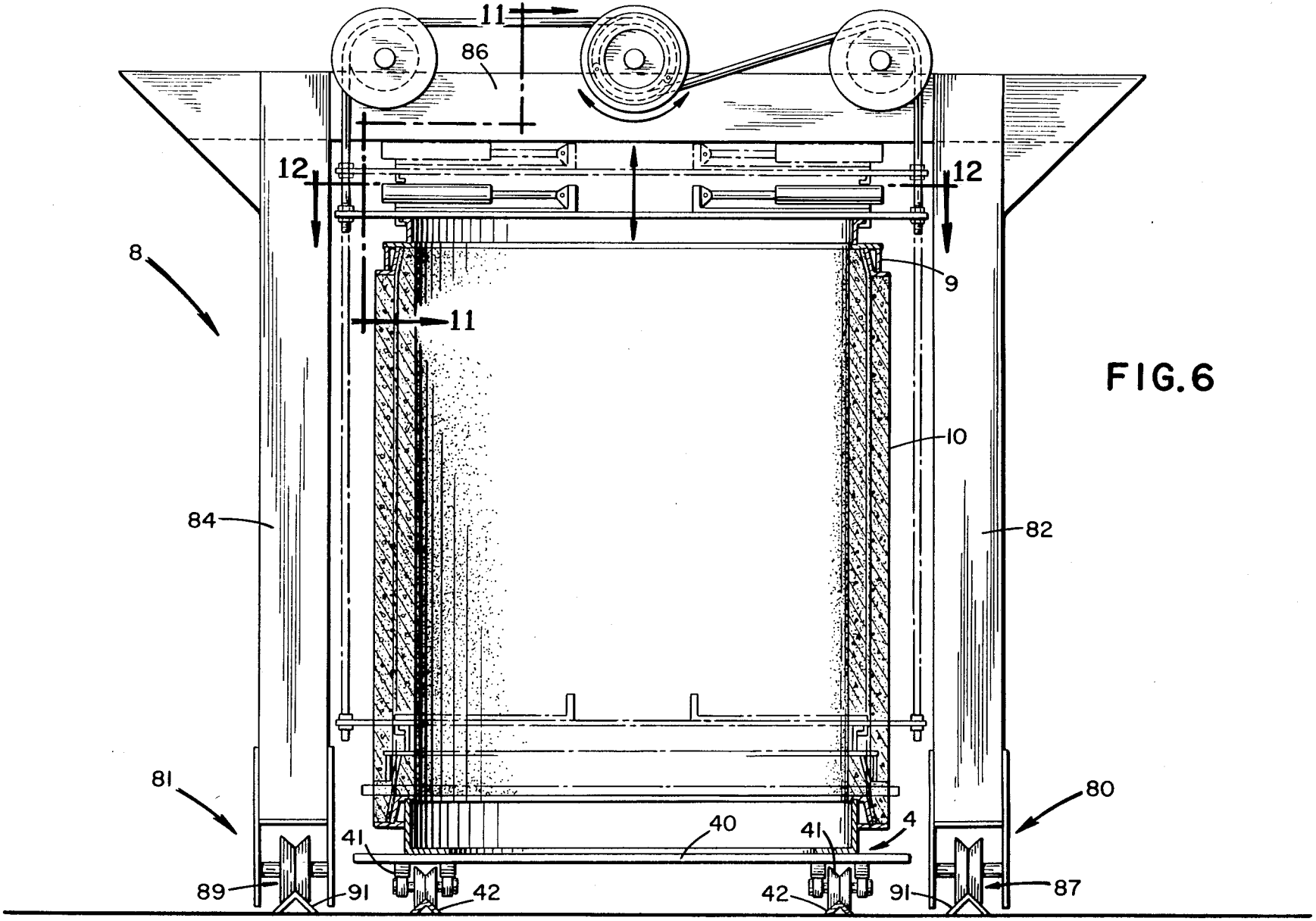
FIG. 6 is a front elevational view of an apparatus, for removing a top pallet from cured pipe.
Figure 7:
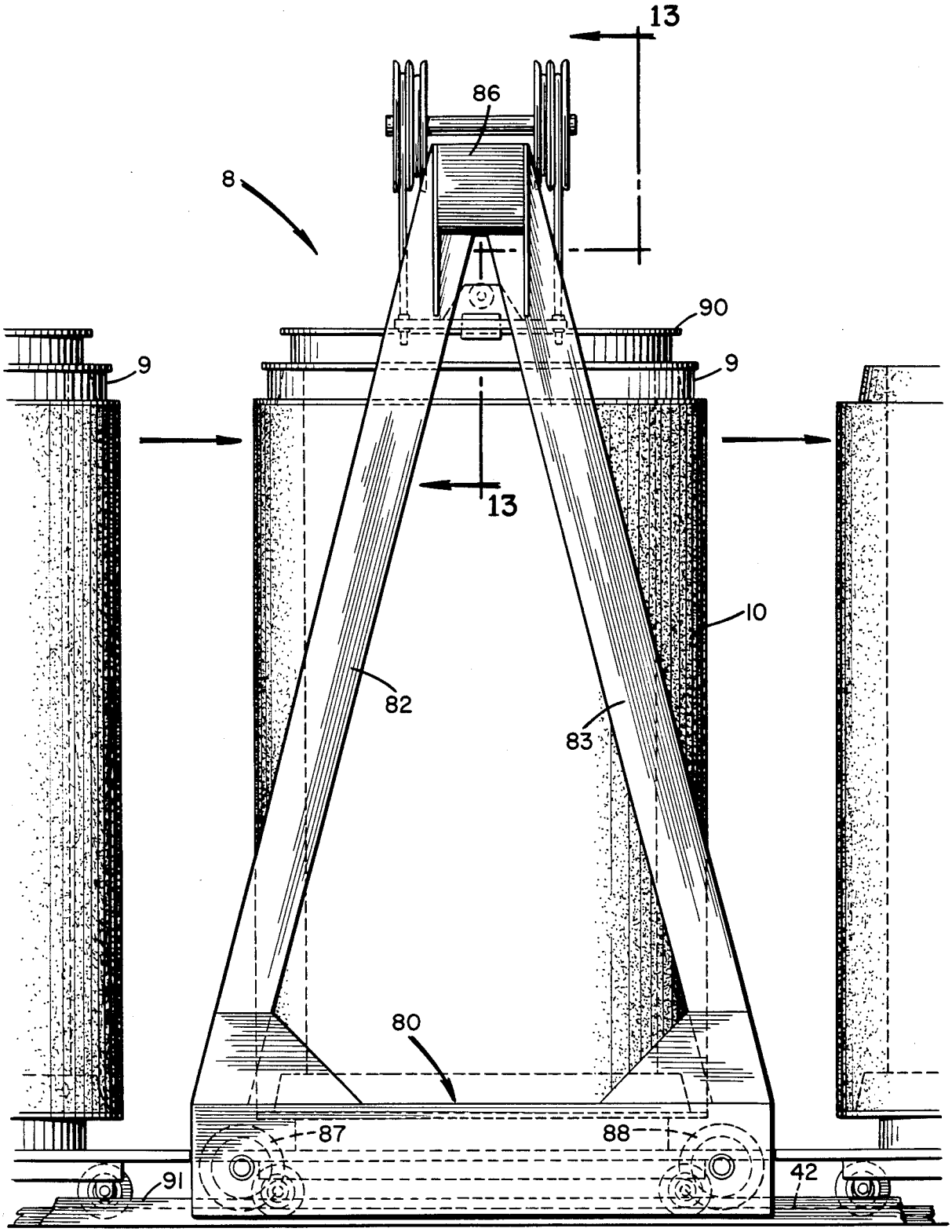
FIG. 7 is a right side view of the apparatus shown in FIG. 6.
Figure 10:
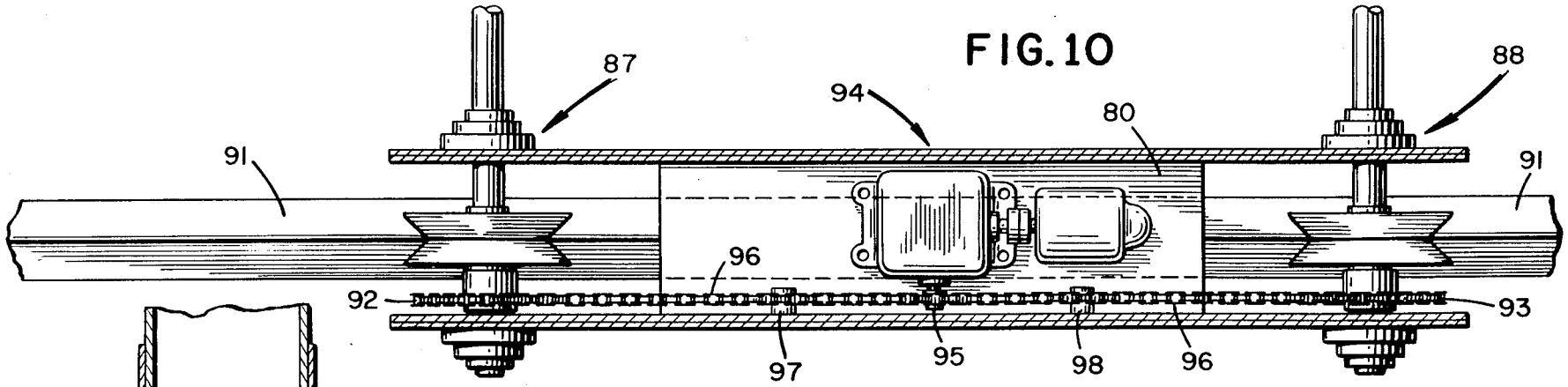
FIG. 10 is a plan view in partial section along the line 10—10 of FIG. 8.
Figure 8:
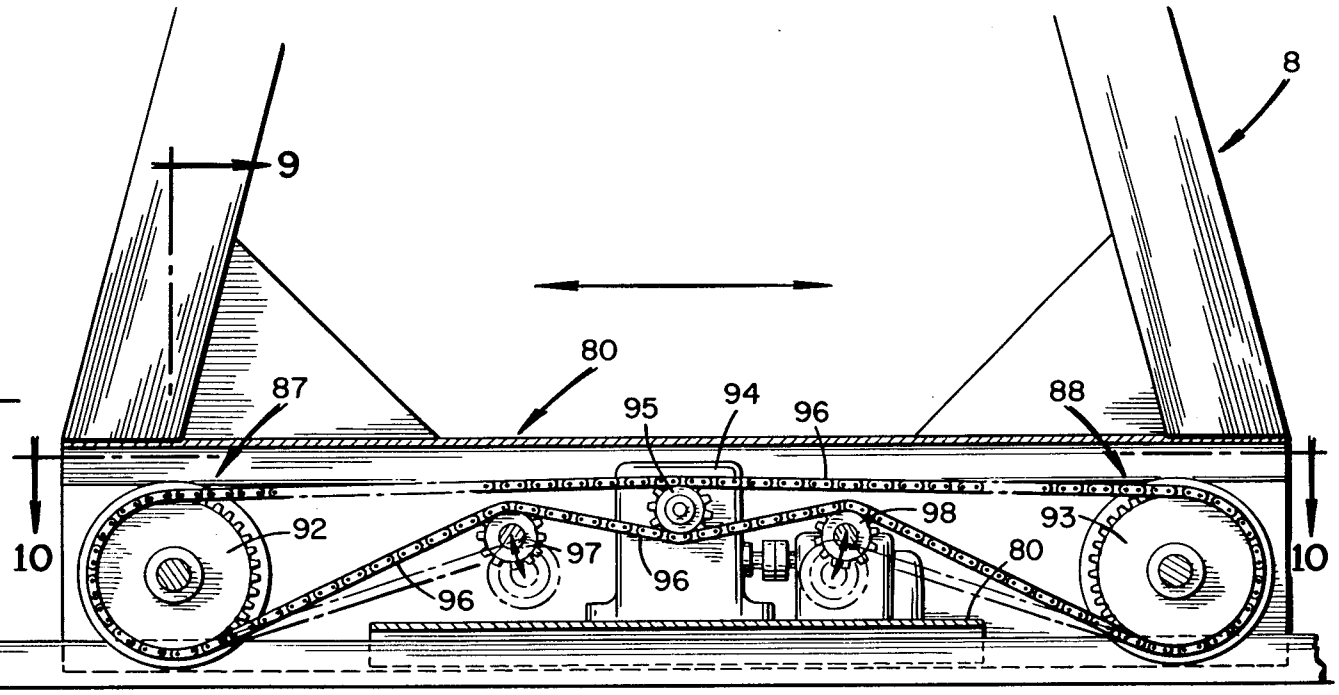
FIG. 8 is a right side view in elevation of the driving assembly for the apparatus shown in FIG. 6.
Figure 9:
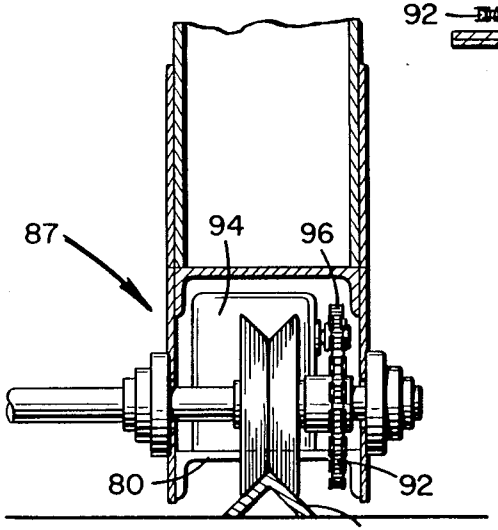
FIG. 9 is a partial cross-sectional view along the line 9—9 of FIG. 6.

FIGS. 6 through 13 show gantry crane 8 which removes the top pallet 9 from the cured pipe 10. Referring specifically to FIGS. 6 and 7 the gantry crane 8 is composed of two horizontal base channels 80 and 81, legs 82 and 83 which are fixed at their lower ends to the ends of base channel 80, legs 84 and 85 which are fixed at their lower ends to the ends of base channel 81, top channel member 86 which is joined to legs 82, 83, 84 and 85 at their upper ends to form an inverted U-shaped configuration in end view, two wheel assemblies 87 and 88 mounted on base channel 80, two wheel assemblies 89 and 90 mounted on base channel 81, motorized unit to raise and lower the top pallet 9, grab hook to grasp the top pallet and driving assembly to move the gantry crane 8. The gantry crane 8 rolls on rails 91 positioned outside of and parallel to the rails 42 upon which the pallet cars 4 roll. In FIGS. 8 to 10 is shown the driving assembly by which the gantry crane 8 is moved along rails 91. On each wheel assembly 87 and 88 is mounted a sprocket 92 and 93, respectively. A motor speed-reducer unit 94 is mounted on base channel 80. Rotatable on motor speed-reducer unit 94 is a sprocket 95 which drives a sprocket chain 96 mounted around sprockets 92 and 93. Chain tension adjustable sprockets 97 and 98 are mounted on base channel 80. Upon activation of the motor speed-reducer unit 94 with sprockets 97 and 98 forcing chain 96 into contact with sprocket 95 the gantry crane 8 moves along rails 91 from the location where the top pallet 9 is removed to the location where the top pallet previously cleaned is placed on the wire reinforcing cage 11. After the gantry crane 8 positions the top pallet 9 on the wire reinforcing cage 11 it returns to the location where the top pallet 9 of a cured pipe 10 is removed.

Figure 11:
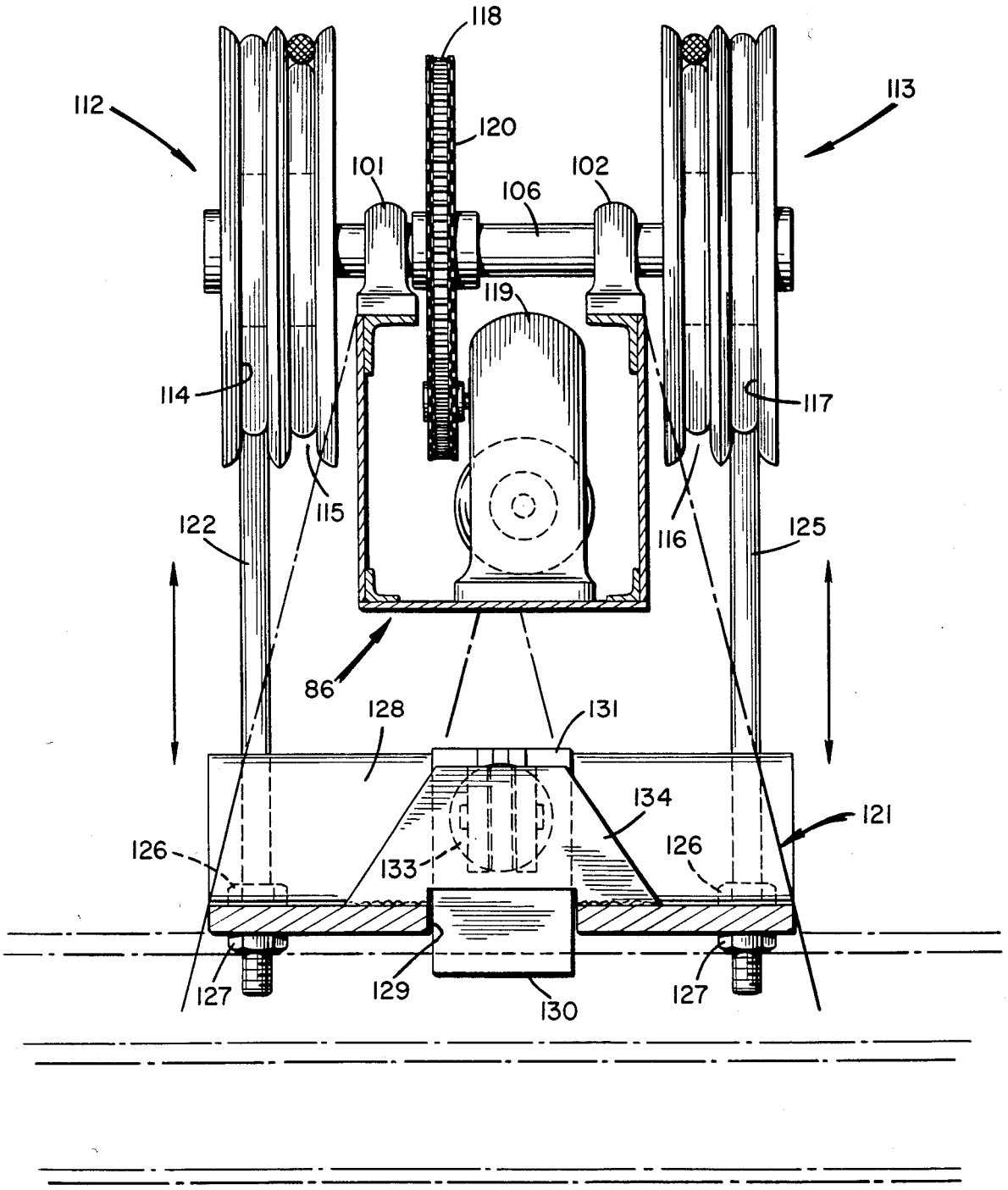
FIG. 11 is an elevational view in partial section along the line 11—11 of FIG. 6.
Figure 12:
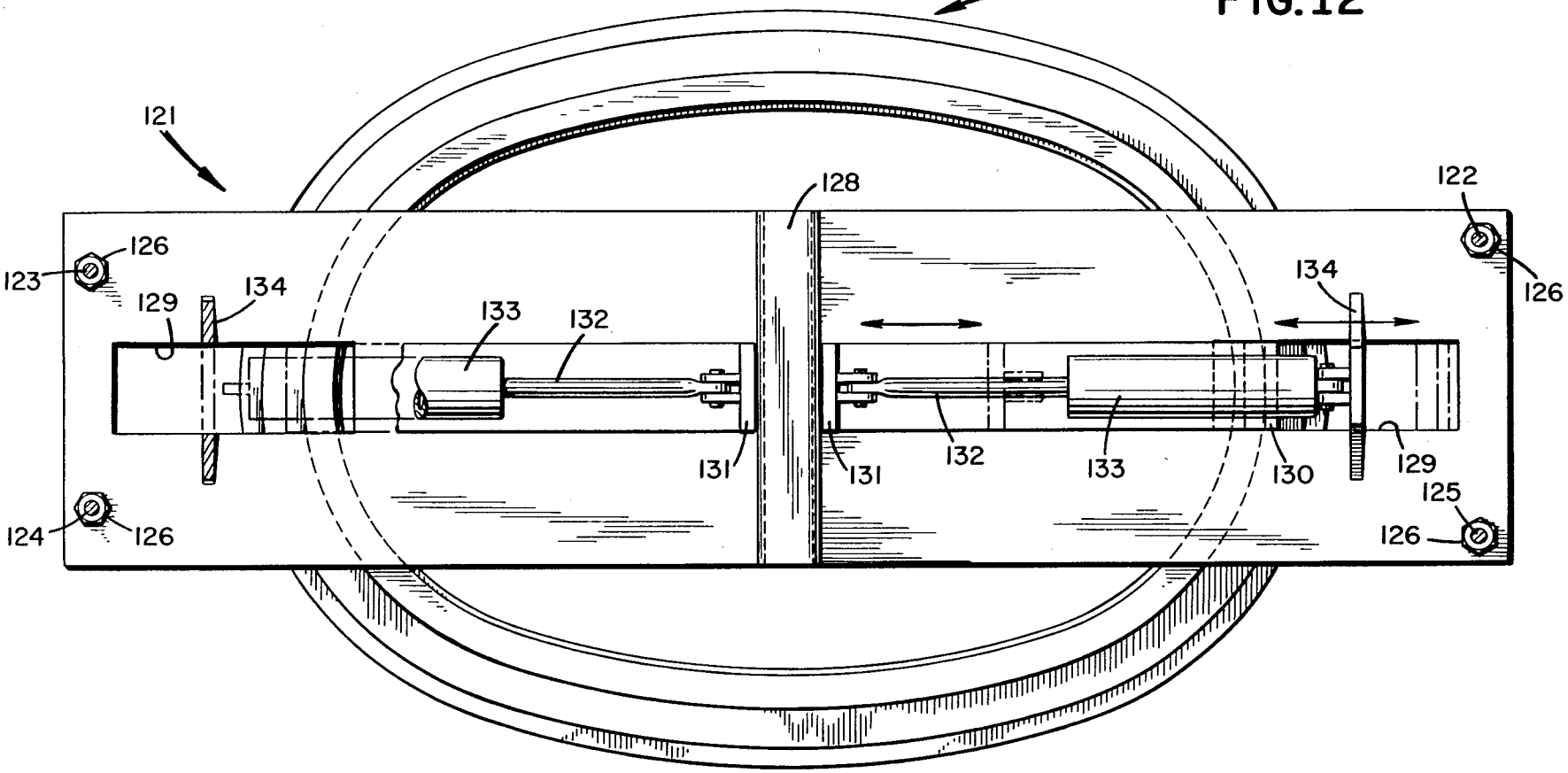
FIG. 12 is a plan view taken along line 12—12 of FIG. 6.
Figure 13:
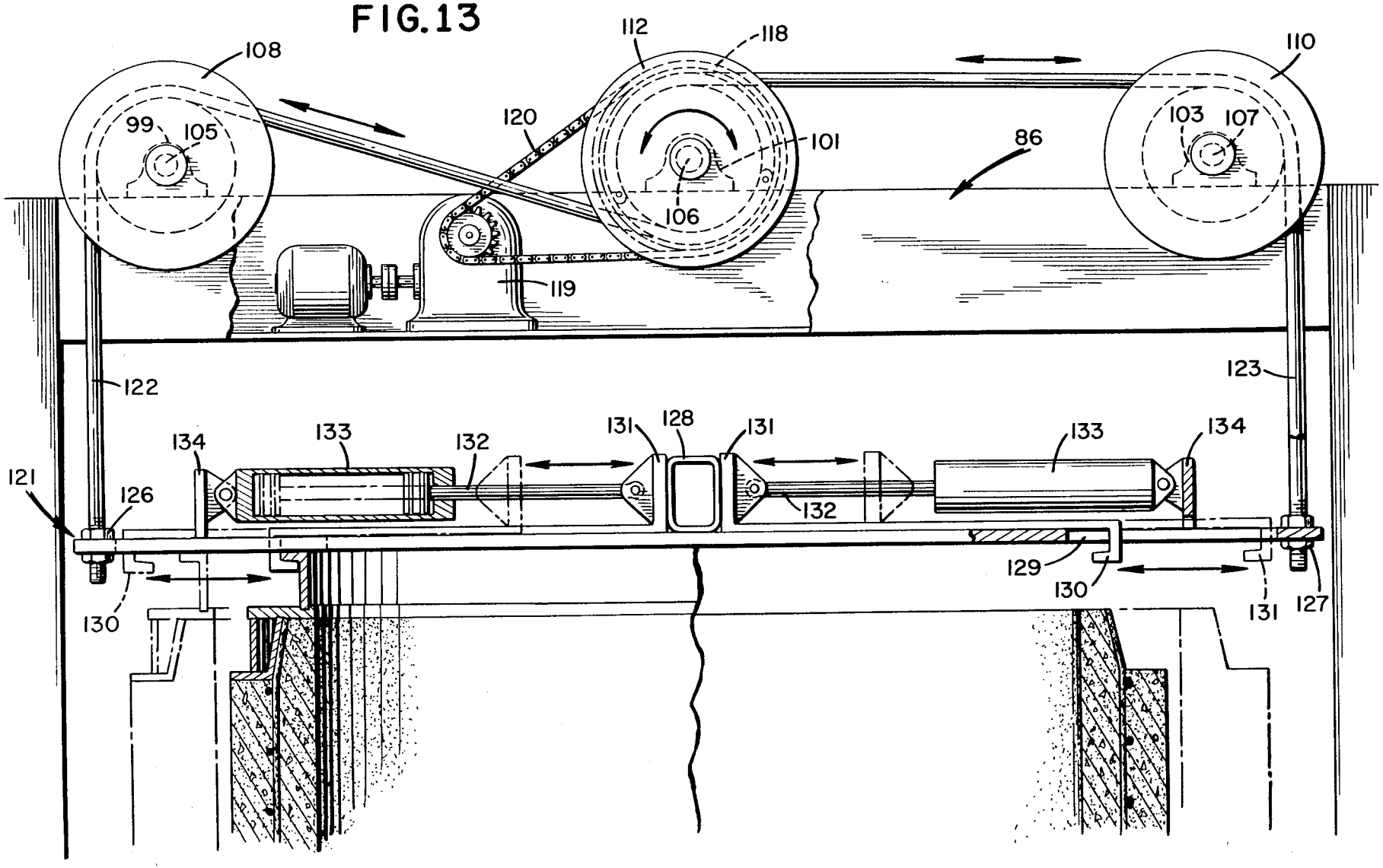
FIG. 13 is an elevation view in partial section taken along line 13—13 of FIG. 7.

The motorized unit for raising and lowering a top pallet 9 is shown in FIGS. 11 to 13. With specific reference to FIGS. 11 and 13 there is shown top channel member 86. Mounted on channel member 86 are bearing members 99, 100 (not shown), 101, 102, 103 and 104 (not shown) supporting shafts 105, 106 and 107. Fixed to shaft 105 are pulleys 108 and 109 only 108 of which is shown in FIG. 13. Fixed to shaft 107 are pulleys 110 and 111 only 110 of which is shown in FIG. 13. Fixed to shaft 106 are pulleys 112 and 113 each having two sheaves 114, 115 and 116, 117. The sheaves 114 and 117 are aligned with pulleys 108 and 109, respectively. Sheaves 115 and 116 are aligned with pulleys 110 and 111, respectively. Also fixed on shaft 106 is a sprocket 118 which is rotated by means of a motor speed-reducer unit 119 mounted on channel member 86 and chain 120. A floating platform 121 is suspended from the channel member 86 by means of wire ropes or roller chain 122, 123, 124 and 125 having threaded end portions only two of which are shown in FIG. 13. The platform 121 is attached to wire ropes 122, 123, 124 and 125 by means of locking nuts 126, 127 threaded onto the end portions thereof. Upon activation of the motor speed-reducing unit 119 the platform 121 may be raised or lowered. The platform contains a transverse stop divider 128 which divides the platform into essentially symmetrical sides. Each side contains a longitudinal slot 129 only one of which is shown. Slidably mounted on the slot is a grab hook 130. The grab hook 130 has a vertical end portion 131 to which is pivotally mounted an end of a piston rod 132 of a hydraulic cylinder 133. The hydraulic cylinder 133 is pivotally mounted on a bracket 134, fixed to platform 121. Upon activation of the hydraulic cylinders 133 the grab hooks 130 move horizontally to take hold of or release the top pallet 9.

Since both sides of transverse stop divider 128 of platform 121 are essentially symmetrical only one has been specifically described.

Figure 14:
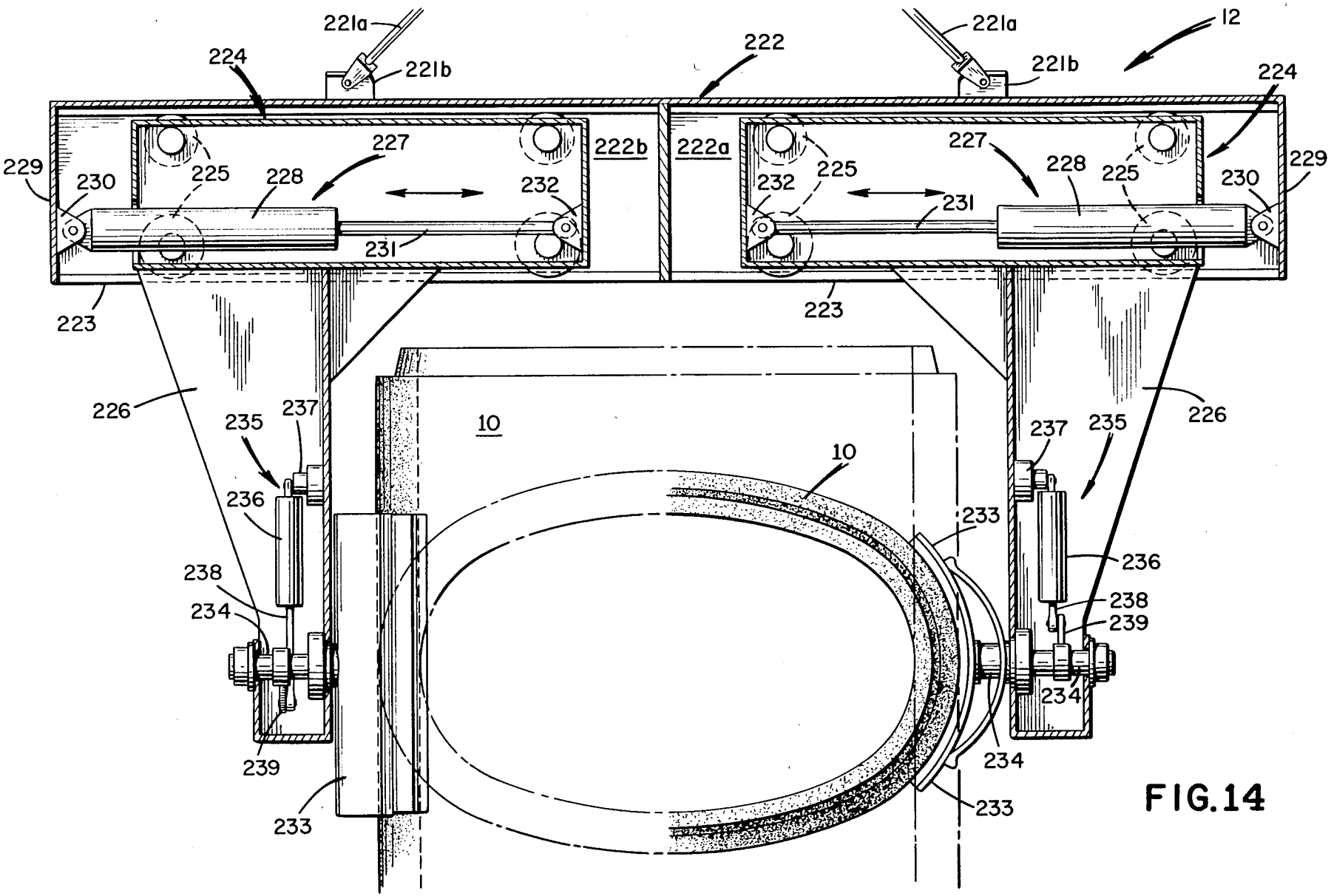
FIG. 14 is a front elevation view in partial section of the pipe clamping and repositioning unit of the present invention.
Figure 15:
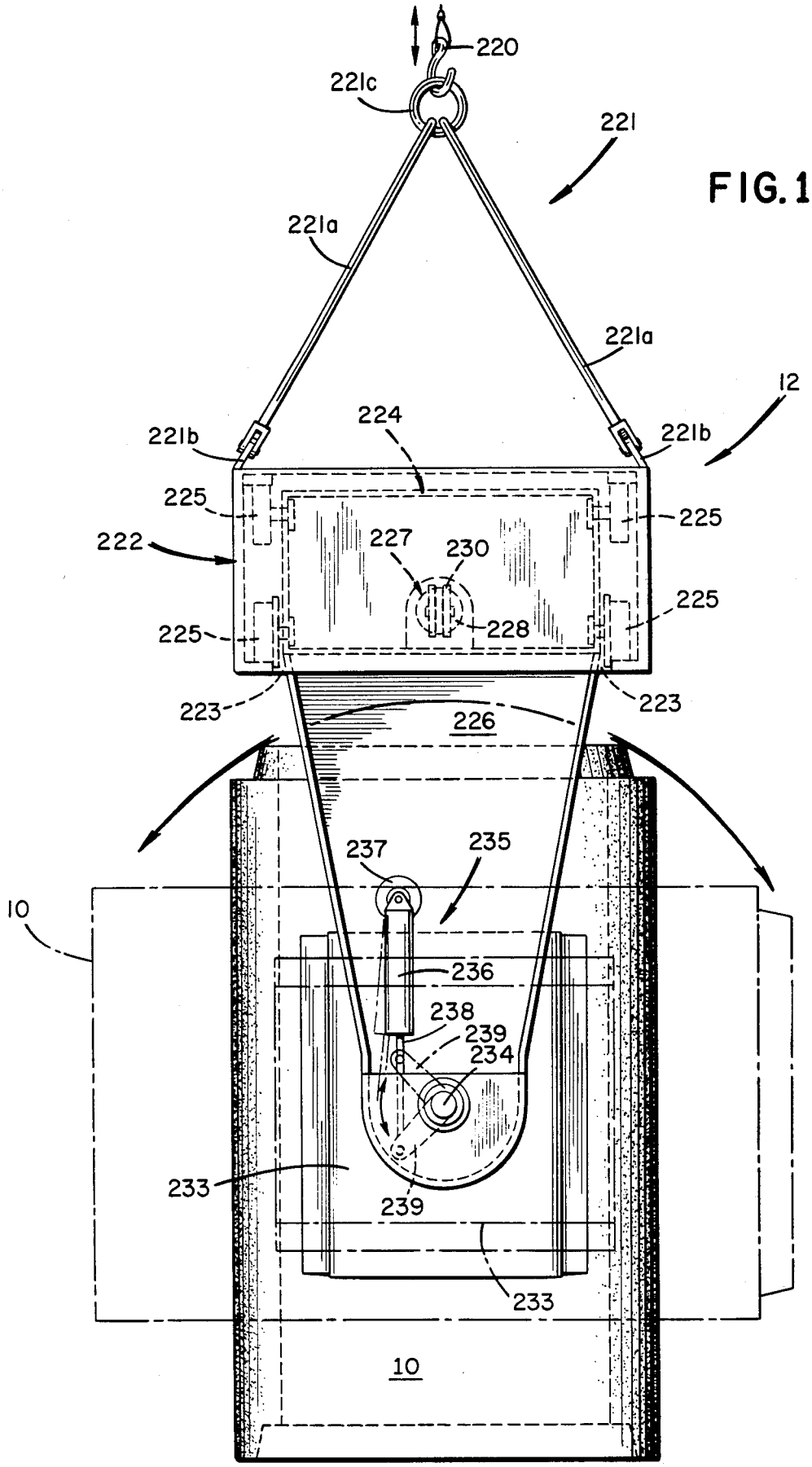
FIG. 15 is a side elevational view of the pipe clamping and repositioning unit of FIG. 14.

In FIGS. 14 and 15 there is shown the pipe clamping and repositioning unit 12 which removes a cured vertically standing pipe 10 from a pallet car 4 and rotates the pipe through a 90° arc so that it can be picked up by a fork lift and removed to a storage area. The pipe clamping and repositioning unit 12 is moved into position over the vertically standing pipe by an overhead crane 220 to which the pipe clamping and repositioning unit 12 is attached by a lifting assembly 221. The lifting assembly is comprised of chains **221*a* attached to brackets 221*b* and passing through ring 221*c*. Ring 221*c* in turn is attached to crane 220. Brackets 221*b* are fixed to a box 222 which is divided into two symmetrical sections 222*a* and 222*b*. Since both sections are the same only one will be described. On the bottom of each section is a rectangular opening 223 (FIG. 15). A carriage 224 moves within box 222 on wheels 225 and has an arm 226 extending through opening 223. The carriage is moved by operating a hydraulic unit 227 which has a cylinder 228 attached to the end 229 of box 222 by a bracket 230 and a piston rod 231 attached to a bracket 232 on carriage 224. Pivotally mounted on the arm 226 is an arcuate clamp panel 233 fixed to shaft 234. A tilting unit 235 is attached to the arm 226. The tilting unit 235 is comprised of a hydraulic cylinder 236 attached to a pivotable bracket 237 fixed on arm 226 and piston rod 238 attached to one end of arm 239 which is fixed to shaft 234 at its other end. The activation of hydraulic unit 227 will move the arcuate clamp panel 233 into contact with the cured pipe 10 after which the overhead crane 220 lifts the pipe 10 from the pallet car 4 and removes the pipe 10 from the loop. Subsequently tilting unit 235 is activated to rotate the pipe 10 from a vertical to a horizontal position. While the pipe 10 is in the horizontal position a forklift moves the pipe 10** to a storage area.

DESCRIPTION OF THE OPERATION

At the beginning of a shift, and before the first cycle is started, the pallet cars 4, transfer cars 6, 13, gantry crane 8 and pipe clamping and repositioning unit 12 are in the following positions. Line A, FIG. 1, is completely filled with pallet cars 4. The pallet car 4 under the pipe forming unit 5 in line A is empty i.e. without a reinforcing cage 11 and top pallet 9 so that the pipe forming unit 5 can be cleaned between shifts. The remaining pallet cars 4 in line A carry vertically positioned pipe sections 10. The transfer car 6 in the kiln does not carry a pallet car 4 but is positioned at the end of line A to receive a pallet car 4 with a pipe section 10 once the first cycle of the new shift is started. The other transfer car 13 is positioned at the beginning of line A with a pallet car 4, a reinforcing cage 11 and top pallet 9 thereon ready for movement onto line A and into the pipe making unit 5 once the cycle is started. Line B is completely filled with pallet cars 4 carrying pipe 10 except for the five pallet cars 4 from which the pipe has been removed positioned closest to transfer car 13. The gantry crane 8 is positioned over the empty pallet car 4 in line B furtherest from transfer car 13. The pipe clamping and repositioning unit 12 is positioned at the side of the gantry crane 8. The pipe forming unit 5 operator to start the first cycle of the shift by his own direction energizes ram 3 which pushes the pallet car 4 with reinforcing cage 11 and top pallet 9 on the transfer car 13 into the pipe forming unit 5. This movement in turn forces the movement of each pallet car 4 a distance equal to the length of one pallet car along line A and the last pallet car 4 on line A onto transfer car 6. The movement of the pallet car 4 onto transfer car 6 trips a normally open switch (L.S.N.O.) which energizes the following semi-automatic cycles: it activates the pipe forming unit 5 and simultaneously energizes the loop cycle which constitutes energizing the motor drive sprockets for transfer cars 6 and 13. Transfer car 6 with a pallet car thereon is moved to the beginning of line B and simultaneously transfer car 13 which is now empty is moved from line A to line B. When transfer car 6 with pallet car 4 and pipe 10 thereon reaches the beginning of line B it trips another normally open limit switch (L.S.N.O.), energizing ram 7, and deenergizing the motor drive sprockets for transfer cars 6 and 13. Ram 7 upon being energized pushes pallet car 4 with pipe 10 off of transfer car 6 onto the beginning of line B which simultaneously moves all pallet cars 4 along line B the distance of the length of one pallet car 4. The pallet car 4 with pipe 10 on line B closest to transfer car 13 is moved under gantry crane 8. The pallet car 4 on line B carrying a cage 11 and top pallet 9 which is closest to transfer car 13 is moved onto transfer car 13. The movement of pallet car 4 carrying a cage 11 and top pallet 9 onto transfer car 13 trips another normally open limit switch (L.S.N.O.) which energizes both the motor drive sprockets for transfer cars 6 and 13 and moves transfer cars 6 and 13 from line B to line A. The tripping of the last mentioned limit switch also energizes the gantry crane 8 to remove the top pallet 9 from the pipe 10 and move the gantry crane 8 to the position for cleaning the top pallet which is over the pallet car 4 in line B which is the third closest to transfer car 13. When transfer car 13 reaches line A it trips a normally closed limit switch (L.S.N.C.) to deenergize the motorized sprockets of transfer cars 6 and 13. The gantry crane 8 upon reaching the position for cleaning the top pallet 9 trips a normally closed limit switch (L.S.N.C.) to deenergize the semi-automatic cycle of the loop system. The deenergizing of the semi-automatic cycle of the loop system does not affect the pipe forming unit 5. The forklift operator once the gantry crane 8 has removed the top pallet 9 from the pallet car 4 in line B carrying the pipe 10 which is closest to transfer car 13 moves by his own direction the pipe clamping and repositioning unit 12 over the pallet car 4 with the pipe section from which the top pallet 9 has been removed, clamps the pipe 10, lifts the pipe 10 from the pallet car 4, removes the clamped pipe 10 from line B, tips the pipe 10 through 90°, forklifts the pipe 10 to the storage area, returns from the storage area and places a reinforcing cage 11 on the pallet car 4 in line B which is closest to transfer car 13.

When gantry crane 8 reaches the cleaning position and stops, the pipe forming unit 5 operator cleans and oils top pallet 9, (a 3 to 5 minute operation), then by his own direction moves gantry crane 8 with its top pallet 9 over the cage 11 which previously has been placed on the pallet car by the forklift operator, sets the top pallet 9 on the cage 11, releases the clamp and starts gantry crane 8, back to the beginning of its track, ready for the next cycle. The gantry crane upon reaching the beginning of its track trips a normally closed limit switch (L.S.N.C.) to stop its movement.

Pipe forming unit 5 operator is now free to move back to pipe forming unit 5 and stop the semi-automatic cycle of pipe forming unit 5 and take over control by his own direction, in order to finish the tongue of pipe 10. The pipe forming unit 5 takes about 10–15 minutes to form a pipe section 10. When the tongue has been completed and pipe 10 partially stripped, the header holding the top pallet 10 unlatches the top pallet 9 from the header, leaving the top pallet 9 on pipe 10. The header then rises to its top position in unit 5 where it trips a normally open limit switch reenergizing ram 3, and starting a new cycle.

Upon bringing a shift to a close, in the next to the last cycle, the forklift operator and pipe forming unit operator do not place a reinforcing cage and top pallet respectively on the last pallet car 4 in line B. However, on the last cycle, they do place a cage and top pallet on the last pallet car 4 in line B to be ready for the following shift.

What is claimed is:

1. A closed single level loop process for manufacturing and handling large, heavy reinforced concrete pipe comprising moving intermittently a reinforcing cage from a starting station on a single level to a molding station on the same level, freshly molding a reinforced concrete pipe around said reinforcing cage, while holding the freshly molded concrete pipe only by ends of the pipe, curing said held freshly molded pipe by intermittently moving said pipe through a curing station on the same level as said molding station, intermittently moving said cured held pipe to said starting station from said curing station, releasing the pipe and repeating the cycle.

* * * * *